US008111133B2

(12) United States Patent
Rodriguez et al.

(10) Patent No.: US 8,111,133 B2
(45) Date of Patent: Feb. 7, 2012

(54) SYSTEM FOR PROCESSING MULTIPLE SIGNAL FREQUENCIES AND DATA FORMATS FOR A BARRIER OPERATOR

(75) Inventors: Yan Rodriguez, Suwanee, GA (US); Ben L. Garcia, Conyers, GA (US); James S. Murray, Glendale Heights, IL (US)

(73) Assignee: Homerun Holdings Corporation, Pensacola, FL (US)

( * ) Notice: Subject to any disclaimer, the term of this patent is extended or adjusted under 35 U.S.C. 154(b) by 1332 days.

(21) Appl. No.: 11/724,937

(22) Filed: Mar. 16, 2007

(65) Prior Publication Data

US 2008/0224885 A1 Sep. 18, 2008

(51) Int. Cl.
*G08C 19/00* (2006.01)

(52) U.S. Cl. ..... 340/5.7; 340/7.1; 340/5.72

(58) Field of Classification Search ..... 340/5.7, 340/5.71, 12.22, 12.28, 5.63, 5.64, 5.23, 340/5.22, 12.23, 12.5, 12.52, 10.1, 10.2, 340/5.61; 235/380, 375, 382
See application file for complete search history.

(56) References Cited

U.S. PATENT DOCUMENTS

| | | | | |
|---|---|---|---|---|
| 4,750,118 | A * | 6/1988 | Heitschel et al. | 700/90 |
| 5,442,340 | A | 8/1995 | Dykema | 340/825.22 |
| 5,479,155 | A | 12/1995 | Zeinstra et al. | 340/825.22 |
| 5,583,485 | A | 12/1996 | Va Lente et al. | 340/525 |
| 5,614,891 | A | 3/1997 | Zeinstra et al. | 340/825.22 |
| 5,661,804 | A | 8/1997 | Dykema et al. | 380/21 |
| 5,686,903 | A | 11/1997 | Duckworth et al. | 340/825.22 |
| 5,793,300 | A | 8/1998 | Suman et al. | 340/825.2 |
| 5,949,349 | A * | 9/1999 | Farris et al. | 340/5.26 |
| 6,025,785 | A | 2/2000 | Farris et al. | 340/825.31 |
| 6,091,343 | A | 7/2000 | Dykema et al. | 340/825.69 |
| 6,181,255 | B1 | 1/2001 | Crimmins et al. | 340/825.69 |
| 703,941 | A1 | 3/2004 | Blaker | 340/825.69 |
| 6,822,603 | B1 | 11/2004 | Crimmins | 341/176 |
| 6,915,146 | B1 | 7/2005 | Nguyen | 455/702 |
| 7,009,529 | B2 | 3/2006 | Hoermann | 340/825.73 |
| 7,290,702 | B2 | 11/2007 | Elberbaum | 235/380 |
| 2003/0033540 | A1 | 2/2003 | Fitzgibbon | 713/200 |
| 2003/0193448 | A1 | 10/2003 | Tsui | 345/48 |
| 2004/0041692 | A1 * | 3/2004 | Lyons et al. | 340/5.64 |
| 2004/0100391 | A1 | 5/2004 | Guthrie | 340/825.69 |
| 2005/0024230 | A1 | 2/2005 | Chuey | 340/825.72 |
| 2005/0024254 | A1 | 2/2005 | Chuey | 341/176 |
| 2005/0026604 | A1 | 2/2005 | Christenson et al. | 455/419 |
| 2005/0026605 | A1 | 2/2005 | Guthrie et al. | 455/420 |
| 2006/0012461 | A1 | 1/2006 | Tsui | 340/5.26 |
| 2006/0103503 | A1 | 5/2006 | Rodriguez | 340/5.71 |
| 2006/0109078 | A1 | 5/2006 | Keller, Jr. et al. | 340/5.64 |

(Continued)

*Primary Examiner* — Nabil Syed
(74) *Attorney, Agent, or Firm* — Renner Kenner Greive Bobak Taylor & Weber

(57) ABSTRACT

A barrier operator is configured to learn and receive disparate wireless transmission signals to control movement of a barrier. The operator includes a receiver core circuit adapted to receive wireless transmission signals containing known and unknown formatted data words. A microcontroller is adapted to determine a fixed code portion of the unknown formatted data words. The microcontroller is also associated with a memory unit and connected to the receiver core circuit for storing in the memory unit the known formatted data words and the unknown formatted data words if the fixed code portion can be determined when the microcontroller is in a learn mode. The receiver core circuit may also scan only frequencies associated with learn codes, pre-selected frequencies, and incremental frequencies within a predetermined range of frequencies.

17 Claims, 8 Drawing Sheets

U.S. PATENT DOCUMENTS

2006/0109079 A1 5/2006 Mack ..... 340/5.71
2006/0198523 A1* 9/2006 Shearer ..... 380/270
2008/0068205 A1* 3/2008 Witkowski ..... 340/825.22
2009/0021348 A1* 1/2009 Farris et al. ..... 340/5.71

* cited by examiner

SYSTEM FOR PROCESSING MULTIPLE SIGNAL FREQUENCIES AND DATA FORMATS FOR A BARRIER OPERATOR

TECHNICAL FIELD

The present invention relates to a barrier operator that controls the movement of an access barrier between opened and closed limit positions and which is configured to process function codes of multiple data formats. Specifically, the present invention is directed to a receiver for a barrier operator that is configured to process function codes that may comprise various fixed code and rolling code data formats. More specifically, the present invention is directed to a barrier operator that is configured to process command signals of different carrier frequencies.

BACKGROUND ART

Barrier operators used to move access barriers, such as garage doors, between opened and closed positions typically maintain various functions that may be actuated via a remote wireless transmitter. As such, the user may remotely implement an open or close barrier function for example, by selecting the appropriate button provided at the remote transmitter. In order to remotely communicate the desired function to be implemented at the barrier operator, the wireless transmitter generates a function code identifying the function or operation to be carried out at the barrier operator. The function code, which contains the information for invoking the desired operation, comprises a specific data format and is transmitted to the barrier operator via a command signal of a predetermined carrier frequency. Once the command signal is received at the barrier operator, the function code is obtained, and the desired operation, such as opening or closing the access barrier, is carried out.

Typical barrier operators are configured to be receptive to, or otherwise compatible with, command signals of a single carrier frequency, and to function codes of only a single data format. Thus, if a user attempts to use a remote transmitter that transmits a command signal on a different frequency or utilizes a function code of a different data format other than that which the barrier operator is compatible, the barrier operator will fail to carry out the desired operation. In other words, in order for the barrier operator to carry out a desired operation, the transmitted command signal and function code are required to be compatible with that of the barrier operator being controlled. One of the reasons such incompatibility exists is due to the fact that manufacturers of barrier operators have not been generally concerned with configuring the receiving circuitry maintained by the operator to be otherwise compatible with command signals of different carrier frequencies and function codes of different data formats. In the past, the technology to allow such compatibility has been costly, thus making it infeasible for manufacturers to provide compatibility between barrier operators and various other remote transmitters that use various formats and carrier frequencies.

However, as data transmission technology has progressed, and as the potential for an unauthorized signal to take control of a device has increased, the need for secure and reliable for wireless devices has come forth. The increase in the use of wireless data communication also requires all wireless devices to become more adept at identifying the transmitted signal in a background of electromagnetic noise. Furthermore, various governing bodies, such as the Federal Communications Commission (FCC), and the European Community have set forth regulations that require manufacturers to comply with certain criteria in which wireless signals are transmitted so as to reduce potential interference. Finally, consumer demand for the convenience provided by wireless devices has prompted barrier operator manufacturers to consistently incorporate new features utilizing wireless technology, as well as extended communication ranges. Thus, to remain competitive, and in light of the aforementioned considerations, manufacturers have been required to periodically modify or alter the communication frequencies and function code data formats utilized by the barrier operator and the remote transmitter to communicate various functions therebetween.

Unfortunately, the modification of the carrier frequencies and function code data formats used by the barrier operator and the remote transmitters to accommodate the latest trends in wireless communication, often results in an incompatibility between barrier operators and remote transmitters of different makes and models. As a result, many remote transmitters, and other wireless devices are rendered incompatible with a given barrier operator.

Therefore, there is a need for a system for processing multiple command signal carrier frequencies and function code data formats for a barrier operator that allows compatibility of the barrier operator with various remote transmitters. Additionally, there is a need for a system for processing multiple function code data formats for a barrier operator that is configured to allow the barrier operator to be receptive to various fixed code and rolling code data formats so as to increase the compatibility of the barrier operator with various remote transmitters. In addition, there is a need for a system for processing multiple command signal carrier frequencies that allows various remote devices to communicate commands using a variety of radio frequency (RF) carrier signals so as to increase the compatibility of the barrier operator with various remote transmitters.

SUMMARY OF THE INVENTION

In light of the foregoing, it is a first aspect of the present invention to provide a system for processing multiple signal frequencies and data formats for a barrier operator.

It is another aspect of the present invention to provide a method for learning a wireless transmitter to a barrier operator, the method comprising receiving a command signal that includes at least two redundant function code data words from a wireless transmitter by a receiver maintained by the barrier operator, determining a data format of the function code data words by a microcontroller connected to the receiver, comparing each of the function code data words if the function code data format cannot be determined at the determining step, and identifying a fixed code portion maintained by each of the transmitted function code data words based on the comparison step.

Yet another aspect of the present invention is a method for learning a wireless transmitter to a barrier operator having a microcontroller controlled multiple-frequency receiver, the method comprising receiving a command signal containing a function code data word from a wireless transmitter, receiving the function code data word at a microcontroller maintained by the barrier operator, determining a data format of the function code data word received by the microcontroller and determining whether the data format contains a fixed code portion or a rolling code portion if the function code data format is identified at the first determining step.

Still another aspect of the present invention is a method of processing received command signals transmitted from a wireless transmitter to a barrier operator so as to actuate an access barrier, the method comprising placing a receiver into a command signal frequency scanning mode, receiving at the receiver a command signal which includes a function code data word associated with a function to be performed by the barrier operator, determining whether a data format of the function code data word is stored in the barrier operator, determining whether any portion of the function code data word matches one or more fixed code tags if the data format of the function code data word is not stored at the barrier operator, and carrying out the function associated with the function code data word at the barrier operator if a match is made at the second determining step.

Yet another aspect of the present invention is a barrier operator configured to learn and receive disparate wireless transmission signals to control movement of a barrier, the operator comprising a receiver core circuit adapted to receive wireless transmission signals containing known and unknown formatted data words, and a microcontroller associated with a memory unit, said microcontroller adapted to determine a fixed code portion of said unknown formatted data words, said microcontroller connected to said receiver core circuit and storing in said memory unit known formatted data words and unknown formatted data words if said fixed code portion can be determined when said microcontroller is in a learn mode.

BRIEF DESCRIPTION OF THE DRAWINGS

These and other features and advantages of the present invention will become better understood with regard to the following description, appended claims, and accompanying drawings wherein:

BEST MODE FOR CARRYING OUT THE INVENTION

Figure 1:
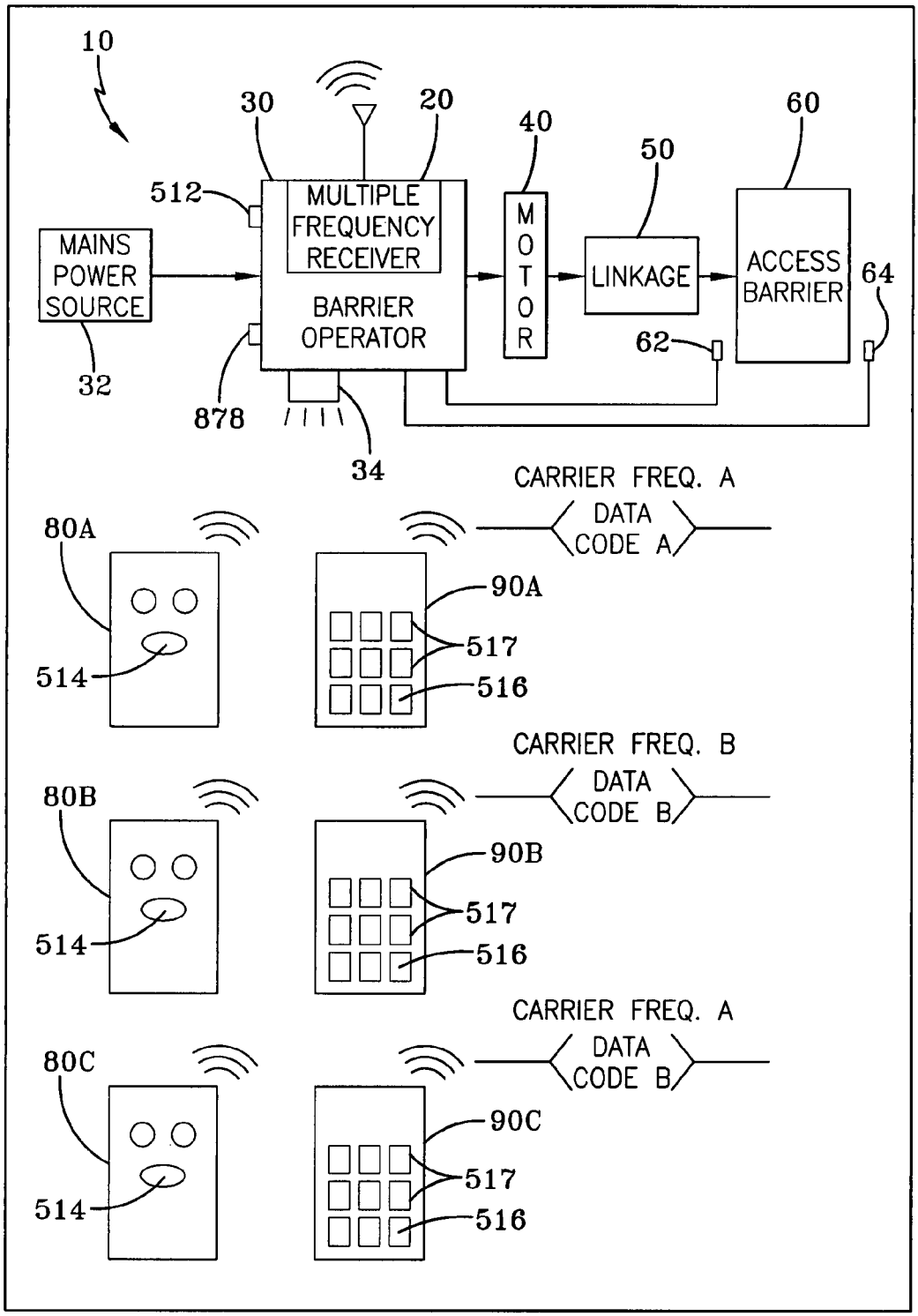
FIG. 1 is a block diagram of a system for processing multiple frequencies and data formats for a barrier operator showing the interaction between various transmitters utilizing various carrier frequencies and data formats to control the movement of an access barrier associated with the barrier operator in accordance with the concepts of the present invention.

A system for processing multiple command signal carrier frequencies and function code data formats for a barrier operator is generally referred to by the numeral 10, as shown in FIG. 1 of the drawings. The system 10 broadly comprises a multiple frequency receiver 20 that is maintained by a barrier operator 30. A feedback source 34, which may be a light emitting diode and/or an audible transducer, is connected to the operator to provide confirmation as to the status thereof. The barrier operator 30 is powered by a suitable power source, such as a mains power source 32 that provides 120 VAC, for example. Of course, other power sources could be used. The barrier operator 30 is configured to generate various control signals to control a motor 40 that drives linkage 50, such as a counterbalance system, so as to move an access barrier 60 coupled thereto between opened and closed limit positions. It should be appreciated that the access barrier 60 may comprise any garage door, curtain, retractable awning, gate, or the like. Spanning across the opening enclosed by the access barrier 60 may be a pair of photo beams 62,64 that are configured to initiate corrective action at the barrier operator 30, such as reversing direction of the access barrier 60, should the photo beams 62,64 detect the presence of an obstacle during movement of the access barrier 60. In order to control the operation of the barrier operator 30, remote transmitters 80A-C and keyless transmitters 90A-C transmit command signals that contain various function codes to the operator 30. The function codes are associated with various operations that may be carried out by the barrier operator 30, and may be invoked by actuating an associated button or keys carried by the transmitters 80A-C,90A-C. For example, a function code may be associated with opening and/or closing the access barrier 60. The carrier frequency of the command signals and the data format of the function code may differ among the various transmitters 80A-C, and 90A-C. As such, the alphanumeric designations as used herein, indicates a distinct carrier frequency designated A-B and function code data format designated A-B that may be associated with a given remote transmitter 80 and keyless transmitter 90. For example, transmitter pair 80,90 designated A utilizes a carrier frequency A and a function code format A; transmitter pair 80,90 designated B utilizes a carrier frequency B and a function code format B; while the transmitter pair 80,90 designated C utilizes a carrier frequency A and a function code format B. In other words, the present invention contemplates that the barrier operator 30 is enabled to be controlled by various transmitters 80,90 that utilize command signals of different carrier frequencies and function codes of different data formats. However, it should be appreciated that the use of the designations A-B for identifying carrier frequencies and A-B for designating data code formats is for illustration only, and in practice the present invention may utilize any variety and configuration of carrier frequencies and data code formats. Indeed, the multiple frequency receiver 20 is configured to receive command signals of various frequencies from the transmitters 80A-C,90A-C, which carry function codes of various data formats. And upon receipt is then able to process the specific command contained within the function code so as to control various functions maintained by the barrier operator 30, such as to move the access barrier 60 between opened and closed positions for example.

Figure 2:
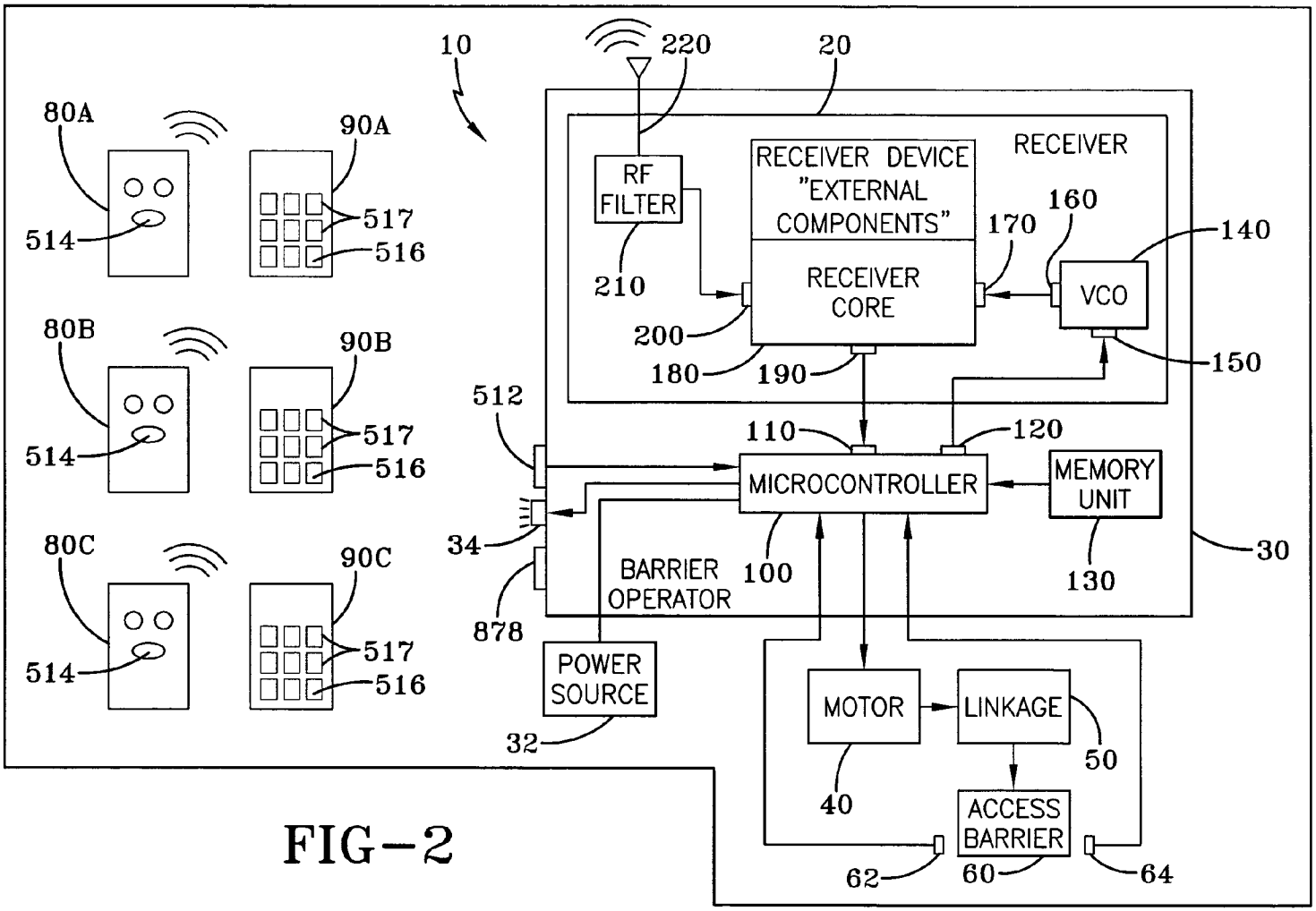
FIG. 2 is a is a block diagram of a system for processing multiple frequencies and data formats for a barrier operator showing a receiver and a microprocessor configured to process multiple carrier frequencies and data formats in accordance with the concepts of the present invention.

Continuing to FIG. 2, the system 10 shows the barrier operator 30 comprising a microcontroller 100. The microcontroller 100 maintains the necessary hardware, software, and memory necessary to carryout the various functions to be described. It should also be appreciated that the microcontroller 100 may comprise an application specific integrated circuit (ASIC) or any general purpose processor that has been suitably programmed or otherwise configured to carryout the described functions. Additionally, the microcontroller 100 maintains a data input 110 and a digital-to-analog (D/A) output 120. Coupled to the microprocessor 100 is a memory unit 130, that may comprise any type of non-volatile memory including: electrically erasable programmable memory (EEPROM), Flash ROM, antifuse memory or the like. In addition, the memory unit 130 may optionally maintain an amount of volatile memory, which may comprise static random access memory (SRAM), dynamic random access memory (DRAM), or the like. In addition to the microcontroller 100, the barrier operator 30 also provides the multi-frequency receiver 20 to enable communication with the various remote transmitters and keyless transmitters 80,90. The receiver 20 includes a voltage controlled oscillator (VCO) 140 that includes a voltage input 150 and an RF control output 160. The voltage input 150 is coupled to the D/A output 120 of the microcontroller 100, while the RF control output 160 is coupled to an RF control input 170 maintained by a receiver core circuit 180. The receiver core circuit 180 maintains the necessary hardware, software, and memory for demodulating and/or decrypting various command signals that are received by the receiver 20 which have been transmitted by the transmitters 80,90. Moreover, the receiver core circuit 180 maintains a data output 190 and an RF control input 200. The RF input 200 is coupled to an RF filter 210. The RF filter 210 is configured to be tuned to pass a predetermined range or bandwidth of command signal carrier frequencies that are received via an antenna 220 coupled thereto. Coupled to the data output 190 of the receiver core circuit 180 is the data input 110 of the microcontroller 100, which enables communication of data there between. In addition to being coupled to the receiver 20, the microcontroller 100 is coupled to the motor 40 enabling the access barrier 60 to be moved between opened and closed limit positions. It should also be appreciated that the receiver 20 may be configured to be removably interfaced with the microcontroller 100, so as to allow a user to upgrade a compatible barrier operator with the functionality provided by the receiver 20. Alternatively, the circuitry of the receiver 20 may be integrated into the circuitry of the microcontroller. Thus, the multiple frequency receiver 20 maintained by the barrier operator 30 is able to receive command signals of various carrier frequencies and process various fixed code and rolling code data formats that may be used by the various transmitters 80A-C, and 90A-C when transmitting a function code to the barrier operator 30.

During operation of the barrier operator 30, the microcontroller 100 is configured to generate and supply an analog voltage level to the D/A output 120, which is coupled to the voltage input 150 of the voltage controlled oscillator (VCO) 140 maintained by the receiver 20. In response to the receipt of the analog voltage level, the voltage controlled oscillator (VCO) 140 generates a carrier signal having a frequency or generates a carrier signal having a fraction of the desired carrier frequency that is proportional to the magnitude of the supplied analog voltage level. The generated carrier frequency value is then delivered to the receiver core circuit 180 via the RF control input 170. As such, the generated carrier wave tunes the receiver core circuit 180, or otherwise makes it responsive to, transmitted command signals having a frequency approximately equivalent to that of the carrier signal generated by the VCO 140. Once the receiver core circuit 180 has been tuned, the RF filter 210 passes command signals received from the antenna 220 that have carrier frequencies that fall within the bandwidth of the RF filter 210. As previously discussed, the RF filter 210 has a defined bandwidth, and acts as a pre-filter allowing only a predetermined range of frequencies to be passed from the antenna 220 to the RF input 200 of the receiver core circuit 180. Such configuration prevents unrelated signals and noise from being passed to the receiver core circuit 180 so that it operates more efficiently and with less interference. Thus, when a command signal having the same carrier frequency as that set at the RF control input 170 is received via the antenna 220 and the RF filter 210, the receiver core circuit 180 begins to demodulate the command signal, and/or decrypt the function code so as to derive the data contained therein. Once the data comprising the function code is extracted from the transmitted command signal, it is passed to the data output 190 of the receiver core circuit 180 for receipt by the microcontroller 100 via the data input 110. Once received by the microcontroller 100, the data comprising the function code is analyzed, and the microcontroller 100 generates suitable control signals so as to control the access barrier 60, and any other accessory associated therewith in accordance with the transmitted function code associated with a function selected at the transmitters 80A-C,90A-C.

Figure 3:
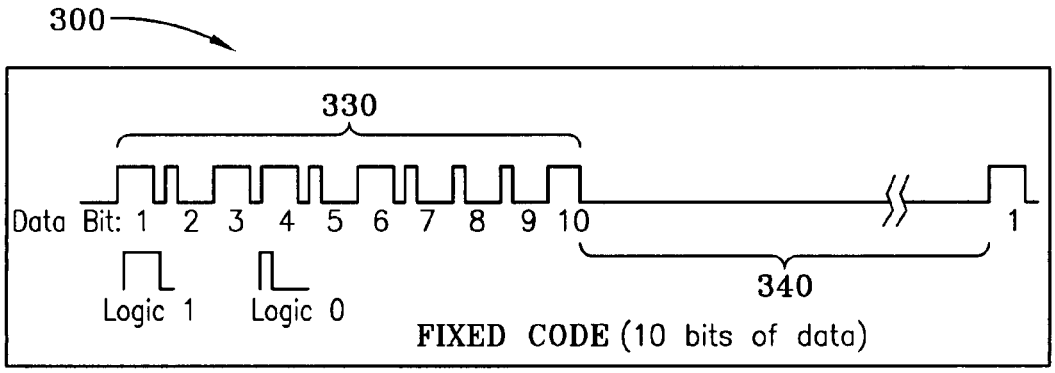
FIG. 3 is a timing chart showing various regions of a fixed code data format in accordance with the concepts of the present invention.
Figure 4:
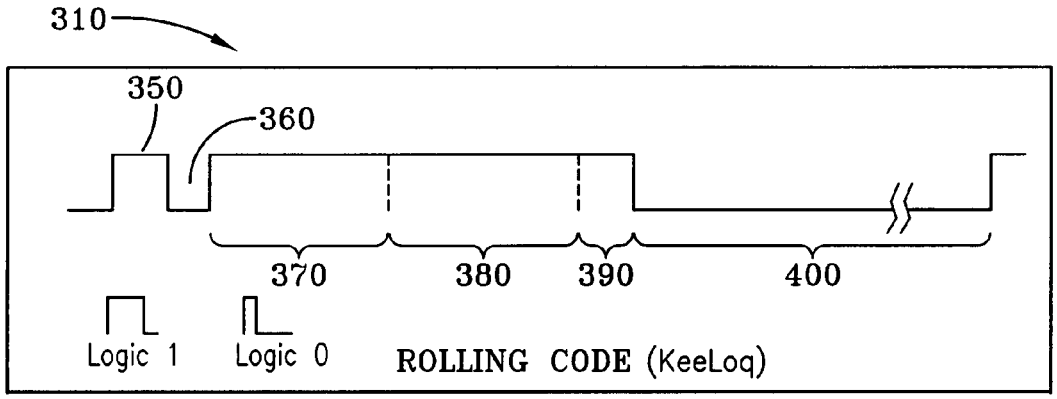
FIG. 4 is a timing chart showing various regions of a rolling code data format in accordance with the concepts of the present invention.
Figure 5:
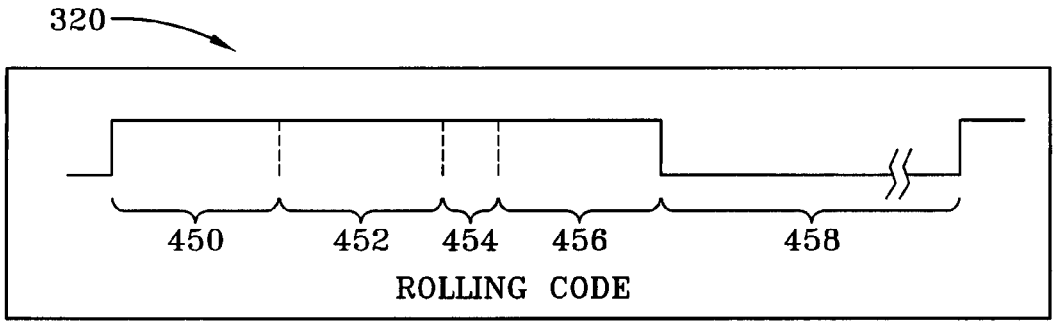
FIG. 5 is a timing chart showing various regions of an alternative rolling code data format in accordance with the concepts of the present invention.

As previously discussed, when a command signal has been received by the receiver core circuit 180, it is demodulated and/or decrypted into binary data that is sent to the microcontroller 150. The microcontroller 150 then analyzes and organizes the data into various data words that make up the function code data. It should be appreciated these binary data words comprise various data formats that may be used by various transmitters 80,90. Specifically, the data format of a particular function code may comprise a fixed code 300, such as that shown in FIG. 3, and/or various rolling codes 310, 320, as shown in FIGS. 4 and 5 respectively. For example, the fixed code in FIG. 3 comprises a data word having various regions including a 10-bit binary data word region 330, and a blank time region 340 that represents a discrete transition between consecutive data words 330. It should be appreciated that the data word region 330 is represented by a series of binary data pulses, that represent a logical "1" or a logical "0." In one aspect, the data word or a portion of the data word region may identify a particular function to be carried out by the barrier operator 30. Additionally, the format for representing a logical "1" may be represented by a high pulse that is approximately 75% of the pulse time, while a logical "0" may be represented by a high pulse that is approximately 25% of the pulse time. Alternatively, a fixed code could utilize a format, such that a logical "1" is represented by a low pulse that is approximately 75% of the pulse time, while a logical "0" is represented by a low pulse that is approximately 25% of the pulse time. Moreover, the fixed code 300 shown in FIG. 3, and discussed above represents only one format that can be utilized by the fixed code 300, and as such, such discussion should not be construed as limiting.

Continuing to FIGS. 4 and 5, it is shown that function codes may comprise a data word having a format comprising rolling codes 310 and 320, which are configured to have a rolling portion that changes after each transmission of a command signal is sent by each of the transmitters 80A-C,90A-C. Specifically, FIG. 4 shows the rolling code 310, which is provided under the trademark KEELOQ®, and which comprises a function code having a format comprising a preamble region 350, a header region 360, a fixed code region 370, a rolling code region 380, a button code region 390, and a blank time region 400. It should be appreciated that these regions 350-400 are comprised of a binary pulse train configured to represent the transmitted function code to be processed by the barrier operator 30.

FIG. 5 shows the alternative rolling code 320, which provides a function code data format that differs from that discussed with regard to the rolling code 310 discussed with regard to FIG. 4. Specifically, the rolling code 320 comprises a fixed code region 450, a counter value region 452, a command byte region 454, a message authentication code region 456, and a blank time region 458. It should be appreciated that these regions 450-458 are comprised of a binary pulse train configured to represent the transmitted function code to be processed by the barrier operator 30. Moreover, the term "rolling code" as used herein refers to function codes 310,320 that have at least one rolling portion, even though the function code may contain a fixed code as well. Additionally, function codes having only a fixed portion and no rolling portion are referred to as fixed codes 300. Thus, while various function code data formats 300,310,320 have been discussed, it should be appreciated that such discussion should not be construed as limiting, and that other data word formats exist and may be utilized in association with the system 10. In addition, the barrier operator 30 may be configured to be initially responsive to a particular data format and/or carrier frequency, and then reconfigured to learn additional carrier frequencies and function code data formats so as to enable various other remote wireless transmitters to invoke functions at the barrier operator 30.

Figure 6:
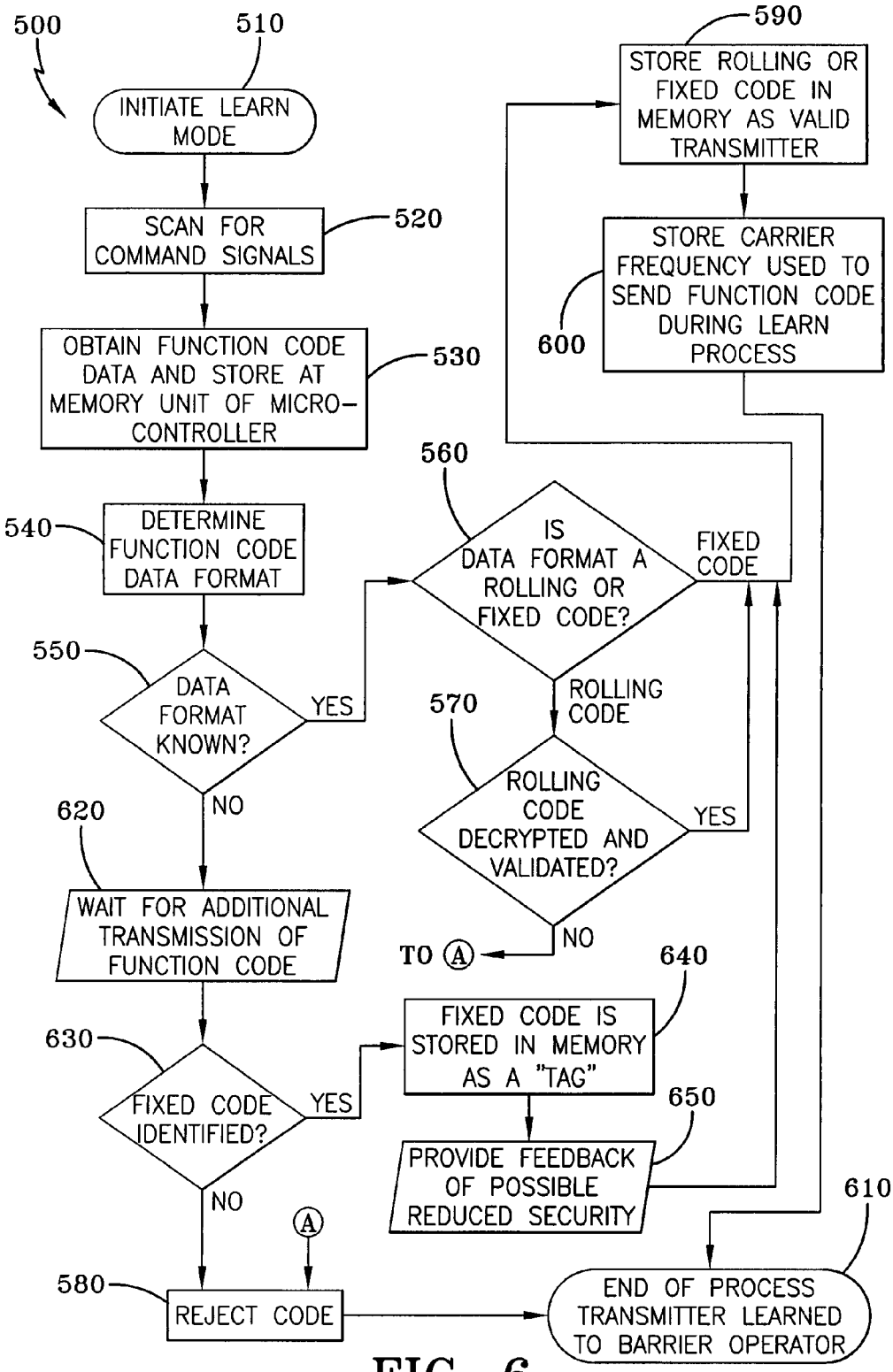
FIG. 6 is a flowchart showing the operational steps taken by the system when the barrier operator and various remote transmitters are placed into a learn mode in accordance with the concepts of the present invention.

In order to associate the transmitters 80A-C and 90A-C, which utilize command signals of various carrier frequencies, and function codes that utilize various data formats, with the barrier operator 30, a learning mode may be initiated between one of the transmitters 80A-C and 90A-C and the barrier operator 30. The operational steps associated with the learning mode are generally referred to by the numeral 500 as shown in FIG. 6. Initially, the learning process 500 is invoked at step 510 by depressing an operator learn/scan button 512 maintained by the barrier operator 30 and respective transmitter learn/scan buttons 514 and 516 that are associated with the transmitters 80A-C, 90A-C. It should be also be appreciated that in lieu of the learn button 516, the keyless entry transmitter 90 may invoke the learn mode by depressing a predetermined sequence of keys via a keypad 517. It will be appreciated that other well known code learning methodologies could be used. Once the learning process is started at step 510, the receiver 20 maintained by the barrier operator 30 begins to scan for command signals sent from one of the transmitters 80A-C,90A-C, as indicated at step 520. It should be appreciated that the receiver 20 may be configured to scan any desired bandwidth of command signal carrier frequencies or specific discrete command signal carrier frequencies during step 520. Next, at step 530, after a command signal has been received by the receiver 20, the microcontroller 100 demodulates and/or decrypts the received command signal and obtains the function code data contained therein. Once the function code data is obtained and stored at the memory unit 130, the process 500 continues to step 540. At step 540, the microcontroller 100 attempts to determine the particular format of the data word that comprises the function code, based upon the following: the quantity of bits received, the pulse width of an individual data pulse, the presence of the preamble region, and the presence of any other particular regions that may comprise a particular function code used by transmitters 80A-C and 90A-C. If the process 500 determines that the data code format is known by the microcontroller 100 by way of step 550, the process 500 continues to step 560, where the microcontroller 100 ascertains the particular data format of the function code. In one aspect, the data format may comprise a fixed code, such as the fixed code 300 previously discussed with regard to FIG. 3, or a rolling code 310,320 having the format discussed with regard to FIGS. 4 and 5, or may be a function code having any other type of data format. Thus, at step 560, the microcontroller 100 attempts to determine the specific data pattern associated with the data word comprising the transmitted function code. If at step 560 the data word of the transmitted function code contains a rolling code, then the process 500 continues to step 570, where the microcontroller 100 attempts to decrypt and validate the rolling code so as to obtain the various data regions of the data word. If the microcontroller 100 is unable to successfully decrypt and validate the rolling code, the process 500 continues to step 580, where the microprocessor 100 rejects the transmitted function code. However, if the microcontroller 100 is able to decrypt and validate the transmitted rolling code, the process 500 continues to step 590, where the microcontroller 100 stores the rolling code into the memory unit 130 of the barrier operator 30. After the rolling code has been stored, the process 500 continues to step 560 where the microprocessor 100 stores at the memory unit 130 the particular carrier frequency used to transmit the rolling code stored at step 590 of the process 500. In other words, at steps 590 and 600, the microprocessor 100 stores the rolling code and the associated carrier frequency at the memory unit 130 of the barrier operator 30. Once step 600 has been completed, the process 500 concludes at step 610, indicating that the barrier operator 30 has been learned with the particular transmitter 80A-C,90A-C, thus enabling it to control various functions maintained by the barrier operator 30.

However, if at step 560, the microcontroller 100 determines that the format of the transmitted data word comprises a fixed code, the process 500 continues directly to step 590, where the fixed code is stored at the memory unit 130. Whereas, at step 600, the carrier frequency associated with the command signal that was used to send the fixed code stored at step 590 is stored at the memory unit 130. As such, once steps 590 and 600 have been performed, the transmitter 80,90 initiating the process 500 is learned to the barrier operator 30 and the process concludes at step 610.

Returning to step 550, if the microcontroller 100 is unable to determine the particular format of the data word transmitted by the function code, then the process 500 continues to step 620, where the microprocessor 100 waits for an additional transmission of the function code from the transmitter 80A-C,90A-C. In one aspect, it should be appreciated that multiple data words comprising the function code may be provided by each instance of a transmitted command signal. After the additional data words have been transmitted, the process 500 continues to step 630, where the microcontroller 100 determines whether the function code data word contains a fixed code region or a rolling code region that can be used as a decryption key to decrypt associated function codes. Such a data word format determination may be achieved by comparing successive data words with each other, so as to identify which portions of the successive data words change. For example, for a rolling code format one or more data bits will change value compared to the other transmitted function code data words. For a fixed code format, however, all data bits values will remain identical with regard to each transmitted function code data word. Thus, at step 630 the microcontroller 100 attempts to identify the fixed portion of the transmitted function code data word. However, if the fixed portion of the function code is not usable for any given reason, then the function code is rejected and the process 500 concludes, as indicated at step 580. However, if the fixed code portion of the data word is identified, then the process continues to step 640. At step 640, the microcontroller 100 stores the fixed portion of the data word identified at step 630 as a decryption key at the memory unit 130. The microprocessor 100 then identifies and "tags" the specific location where the bits associated with the fixed code in the fixed portion are located within the entire function code data word. In one aspect this may be accomplished by storing the function code data word, and the bit identifier (i.e. number of bits) of the first bit of the fixed portion of the data word along with the total quantity of fixed bits. Another method of storing the bits of the fixed portion of the function code data word is to store the tag as the bit identifier of the first bit of the fixed code data word, and the bit identifier of the last bit of the fixed portion. Still another method, is to tag or identify that the fixed portion begins at a specific time period from the start of the data word, such as 15 ms from the leading edge of the first bit of the data word, along with the time period of the last fixed portion data bit. The decryption key is used to decrypt future function codes, which are transmitted to the barrier operator 30 so as to enable various transmitters 80A-C,90A-C to control various functions maintained by the barrier operator 30.

After the fixed region of the function code data word has been stored at step 640, the process 500 continues to step 650 where the microcontroller 100 generates a visual or audible indication that the function code may not be as secure as possible. Briefly, a rolling code formatted data word, or function code, prevents the copying of the function code by continually changing a portion of the data word for each transmission from the transmitter 80A-C,90A-C. As such, if the microcontroller 100 only learns the fixed portion of the rolling code, then potential exists for an interloper to intercept and copy one of the transmitted function codes to gain control of the barrier operator 30. Therefore, the feedback provided at step 650 gives notice to the user of the reduced security condition, so that he or she can plan accordingly. This feedback form source 34 may take the form of a series of flashes from a visual indicator emanating from a light emitting diode (LED) 34 mounted on the barrier operator by the operator learn/scan button 512. Another source of feedback can be from a series of flashes from a visual indicator emanating from the main service light located on the barrier operator or remotely within the line of sight of the barrier operator (which normally serves to illuminate the garage space). Yet another form of feedback can be a series of audible beeps from a barrier operator-mounted audible transducer. Once step 650 has been completed, the process 500 continues to steps 590 and 600 where the fixed code and the carrier frequency associated with the transmitted command signal is stored at the memory unit 130 of the barrier operator 30 in the manner previously discussed. Once completed, the process concludes at step 610 whereby the selected transmitter 80A-C,90A-C is learned with the barrier operator 30 so as to control one or more functions maintained thereby.

Figure 7:
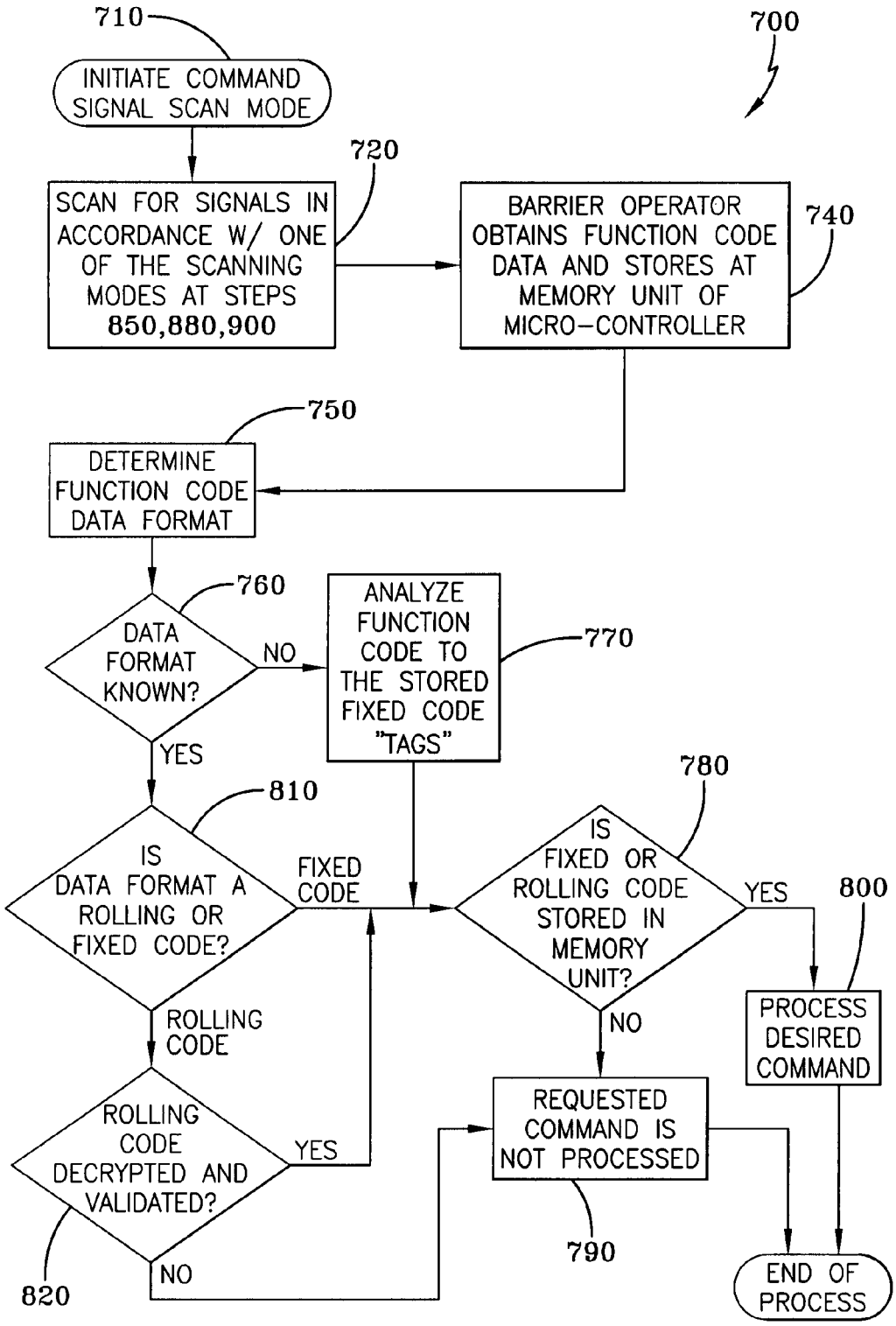
FIG. 7 is a flowchart showing the operational steps taken by the system when the barrier operator is placed in an operation mode in accordance with the concepts of the present invention.

After the barrier operator 30 has been learned with one or more of the transmitters 80A-C,90A-C, the barrier operator 30 is able to be responsive to the particular carrier frequencies and data formats utilized by the command signal and function code generated by the transmitter 80A-C,90A-C. As such, the barrier operator 30 is able to carryout various functions remotely invoked by the transmitters 80A-C,90A-C. The operational steps taken by the barrier operator 30 when a command signal is transmitted by the transmitters 80A-C, 90A-C are generally referred to by the numeral 700, as shown in FIG. 7 of the drawings. Initially, at step 710 of the process 700, the barrier operator 30 is placed into a command signal scanning mode. It should be appreciated that the command signal scanning mode and the learn mode previously discussed with regard to FIG. 6 are the two principle modes provided by the barrier operator 30. And as such, the scanning mode and the learn mode may be selectively invoked, or otherwise toggled, by depressing the operator and transmitter learn/scan buttons 512,514,516 maintained by the barrier operator 30 and the transmitters 80,90. Next, at step 720, the barrier operator 30 places the receiver core circuit 180 into one of a variety of command signal scanning modes, which will be discussed in detail later. Once the receiver core circuit 180 detects a command signal transmitted from one of the transmitters 80,90, the barrier operator 30 obtains the function code and stores it at the memory unit 130, as indicated at step 740. In other words, to command the barrier operator 30 to perform a desired operation, the user selects a desired function at the transmitter 80A-C,90A-C, causing a command signal containing a function code associated with the function to be performed to be sent to the barrier operator 30. Next, at step 750, the microcontroller 100 analyzes the data format of the stored function code data word, assessing as to whether the format of the function code comprises a fixed code, a rolling code, or any other code format. At step 760, if the process 700 determines that the format of the function code data word cannot be determined by the microcontroller 100, then the process 700 continues to step 770. At step 770, the process 700 compares the various data regions of the transmitted function code data word with various fixed codes that have been previously stored at the memory unit 130 of the barrier operator 30. If the barrier operator 30 is unable to match any of the data regions of the function code with the fixed codes stored at the memory unit 130 at step 780, then the requested function identified by the function code is not processed by the barrier operator 30, as indicated at step 790 of the process 700. However, if at step 780, the barrier operator 30 is able to match at least one of the data regions of the function code data word with various fixed codes stored at the memory unit 130, then the process 700 continues to step 800. At step 800, the barrier operator 30 proceeds to carry out the requested function identified by the transmitted function code. For example, if the user transmitted a function code associated with an access barrier close operation, then the barrier operator 30 moves the access barrier 60 accordingly.

Returning to step 760, if the microcontroller 100 identifies the data format of the transmitted function code data word, then the process 700 continues to step 810 where the microprocessor 100 determines whether the function code data word contains a rolling code portion or a fixed code portion. If the microprocessor 100 determines that the transmitted function code contains a fixed code, then the process 700 proceeds to carry out steps 780-800 as previously discussed. In other words, if the transmitted function code contains a fixed code that is stored at the barrier operator 30, the operation requested by the transmitter 80,90 is carried out by the barrier operator 30. However, if at step 810, the process 700 determines that the function code data word includes a rolling code, the process continues to step 820 where the microcontroller 100 of the barrier operator 30 attempts to decrypt and validate the rolling code. If the barrier operator 30 is unable to decrypt and validate the rolling code maintained by the transmitted function code, then the function requested via the transmitter 80,90 is not processed as indicated at step 790. However, if the microcontroller 100 is able to decrypt and validate the rolling code at step 820, the process 700 proceeds to carry out steps 780-800 as previously discussed.

In regard to step 720 of the command signal scanning mode 700, the receiver 20 may be configured to scan for various transmitted command signals in a variety of manners. By providing various methodologies in which the receiver 20 may scan for transmitted command signals, the processor 100 and receiver 20 may be able to conserve processing cycles allowing the system 10 to operate more efficiently. In one aspect, the system 10 may comprise various command signal scanning modes, which comprise an initial use/discrete mode, a scan all mode, and a scan stored mode, which will be discussed more fully below. Thus, the discussion that follows relates to these various scanning modes that can be selectively carried out at step 720 of the process 700. It should also be appreciated that the various scanning modes may be invoked by actuating a dedicated scan button 878 maintained by the barrier operator 30.

Figure 8:
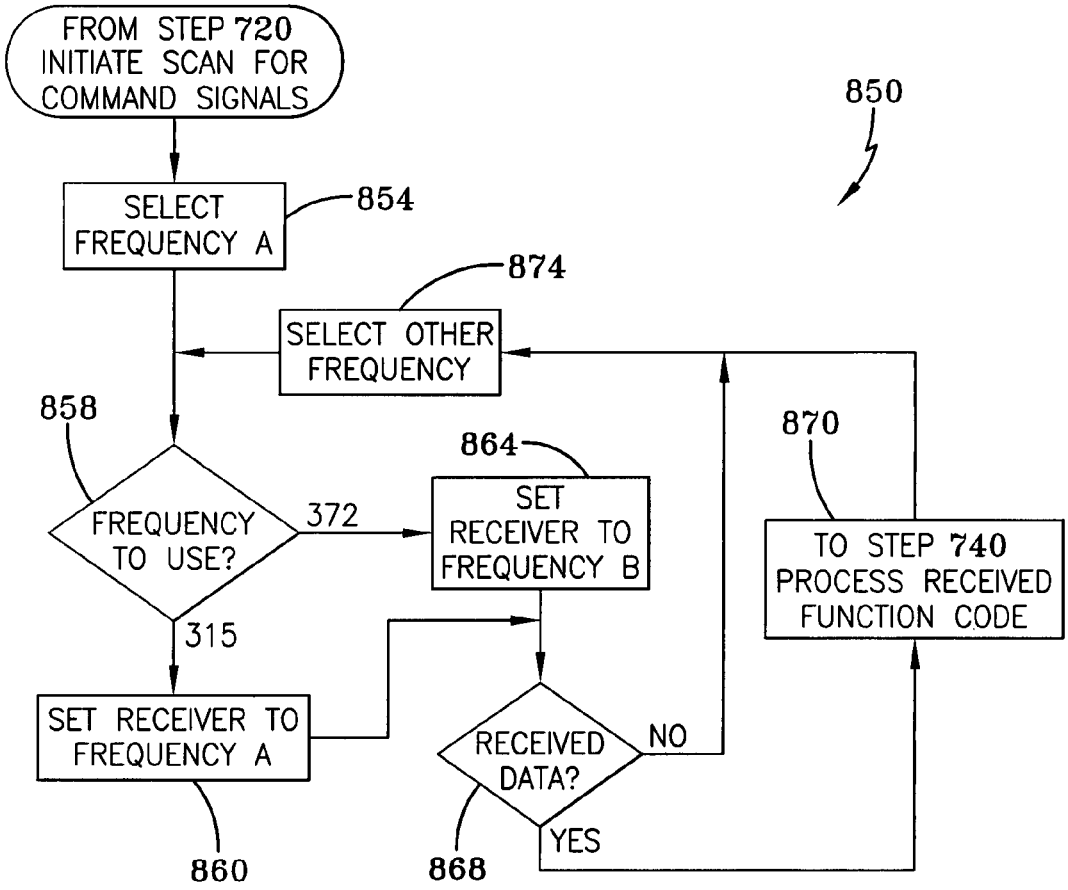
FIG. 8 is a flowchart showing an initial frequency scanning process performed by a receiver maintained by the barrier operator in accordance with the concepts of the present invention.

The initial use mode may be invoked by the barrier operator 30 upon initial installation, until the user elects to change to the scan stored mode. The operational steps for scanning a predetermined number of discrete command signal carrier frequencies that are associated with the initial use mode are generally referred to by the numeral 850, as shown in FIG. 8. Specifically, the process 850 associated with the initial use scanning mode is initiated when the barrier operator 30 is placed into service and the command signal scan mode is initiated at step 710 of the process 700 as previously discussed. Once the initial use scanning mode is invoked at step 720 of the process, the initial scanning mode continues to step 854, where the microcontroller 100 scans for an initial frequency A, such as 315 MHz, for example. If the microcontroller 100 selects the first frequency, such as 315 MHz, then the microcontroller 100 tunes the receiver 20 to be responsive to such frequency, as indicated at step 860. However, if the microcontroller 100 selects the second frequency B, such as 372 MHz, for example, the microcontroller 100 tunes the receiver 20 to be responsive to such frequency, as indicated at step 864. Regardless of which frequency is selected by the receiver 20 at step 858, the process 850 continues to step 868, where the microcontroller 100 determines whether any command signal having the tuned frequency has been received. If a transmitted command signal has been received by the barrier operator 30, then the process 850 continues to step 870 where the function code contained by the command signal is processed in accordance with the steps 740-820 previously discussed with regard to the process 700 shown in FIG. 7. However, if a command signal is not received by the barrier operator 30 at step 868, then the process 850 continues to step 874, where the microprocessor 100 re-tunes the receiver 20 to another frequency by way of step 858. Although, the process 850 discussed above makes reference to scanning for command signals having one of two different carrier frequencies, it should be appreciated that the process 850 may be readily configured to scan for any number of frequencies or predetermined frequency ranges.

Figure 9:
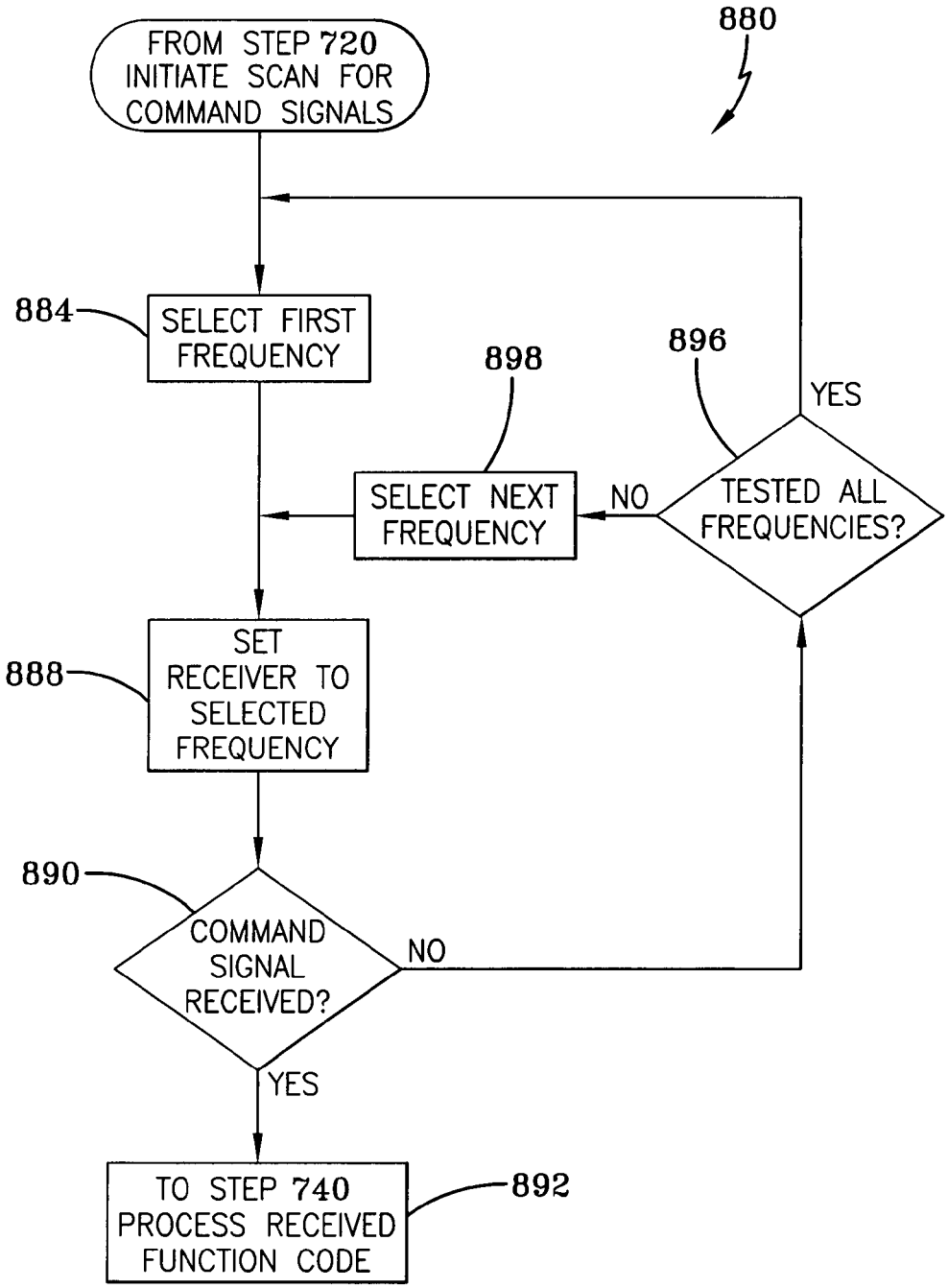
FIG. 9 is a flowchart showing an alternative frequency scanning process performed by the receiver in which all carrier frequencies stored at the barrier operator are scanned for valid function codes in accordance with the concepts of the present invention.

In addition to scanning for discrete frequencies, the receiver 20 may provide the scan all mode that is configured to scan a frequency bandwidth of a predetermined range, and at a predetermined scanning resolution. For example, the receiver 20 may scan or step through carrier frequencies within the range of 290 MHz to 440 MHz, at a step resolution of 1 MHz, for example. In other words, the receiver 20 scans the range of carrier frequencies by stepping through the defined bandwidth at 1 MHz increments. However, it should be appreciated that any bandwidth and/or resolution may be utilized by the barrier receiver 20. The operational steps taken by the barrier operator 30 when the receiver 20 is placed in the scan all mode, are generally referred to by the numeral 880 as shown in FIG. 9. Specifically, the process 880 associated with the all scan mode is initiated when the barrier operator 30 is placed into service by invoking the command signal scan mode via the scan button 878 initiated at step 710 of the process 700 as previously discussed. Once the all scan mode is invoked at step 720 the process continues to step 884. At step 884, the microprocessor 100 selects a first frequency out of a predetermined range or bandwidth of frequencies that have been previously stored at the memory unit 130 of the barrier operator 30. Next, at step 888, the microprocessor 100 tunes the receiver 20 to be responsive to the frequency selected at step 884. Once the receiver 20 has been tuned, the microprocessor 100 determines whether a command signal has been received at the receiver 20, as indicated at step 890. If a valid command signal has been transmitted, the process 880 continues to step 892, where the function associated with the transmitted command signal is carried out in accordance with the steps 740-820 as discussed with regard to the process 700 shown in FIG. 7. However, if the microprocessor 100 does not receive a command signal at step 890, then the process 880 continues to step 896. At step 896, the microprocessor 100 determines if it has scanned the entire bandwidth of frequencies stored in the memory unit 130. If the microprocessor 100 has scanned the entire bandwidth of stored frequencies, then the process 880 continues to step 884. However, if the microprocessor 100 determines that it has not scanned the entire bandwidth of frequencies stored in the memory unit 130, the process 880 continues to step 898, where the microprocessor 100 tunes the receiver 20 to another frequency. Once the receiver 20 is tuned to the new frequency the process continues to step 890 and the process 880 is carried out in the manner previously discussed. It should be appreciated that the receiver 20 may be tuned upward or downward at a predetermined resolution such as 1 MHz, for example, although any other degree of precision may be utilized. Thus, the process 880 allows the receiver 20 to continuously step through a bandwidth of predetermined carrier frequencies so as to allow the receiver 20 to identify a command signal sent from one or more of the various transmitters 80,90 command signals having various carrier frequencies.

Figure 10:
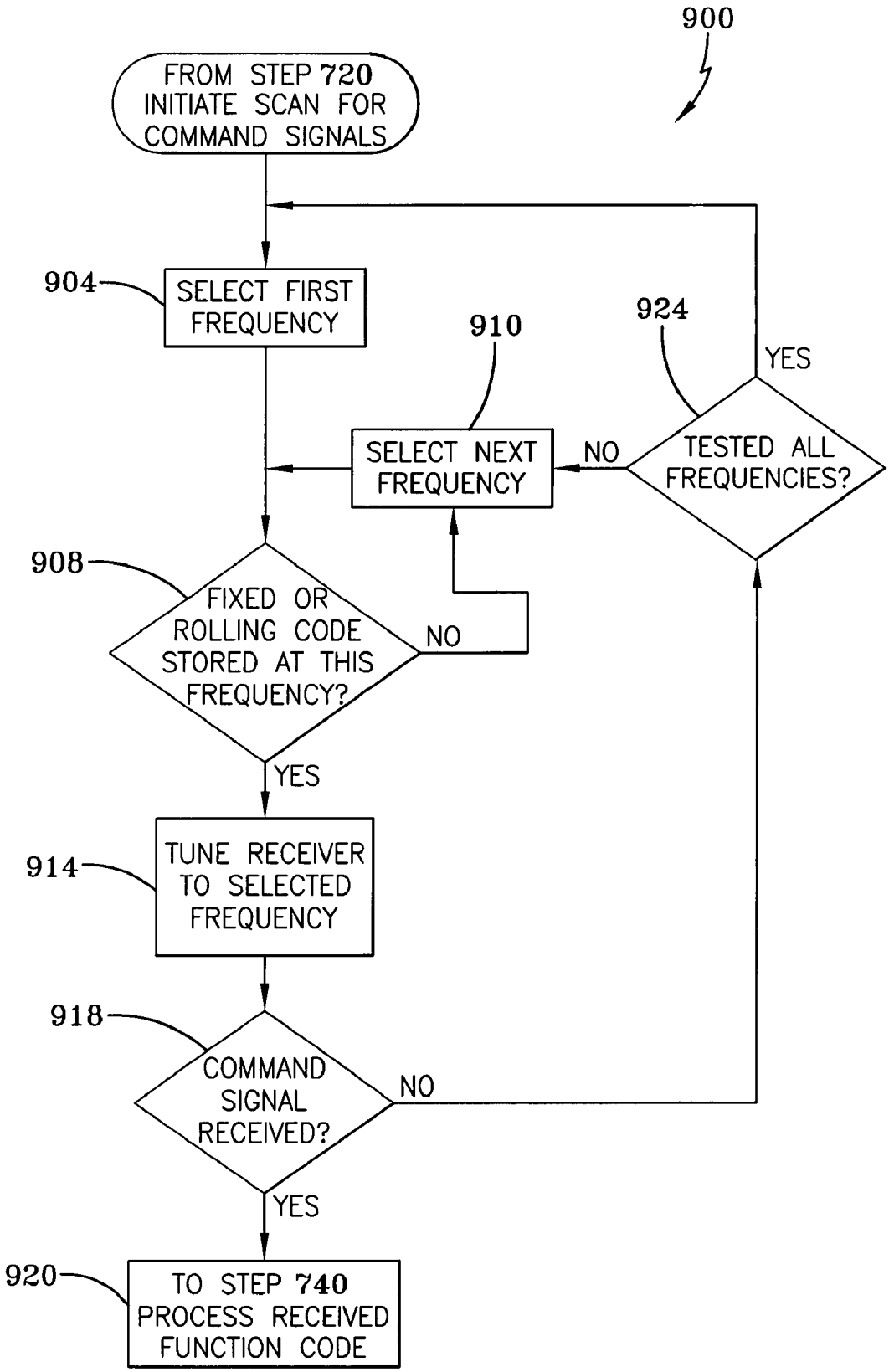
FIG. 10 is a flowchart showing another alternative frequency scanning process performed by the receiver in which only carrier frequencies of remote transmitters that have been previously learned with the barrier operator are scanned in accordance with the concepts of the present invention.

Another mode for which the barrier operator 30 may scan for transmitted command signals is referred to the stored scan mode. When placed in the stored scan mode, the receiver 20 only scans for command signals having carrier frequencies that have been previously learned with the barrier operator 30 during the learn mode previously discussed with regard to process 500 shown in FIG. 6. As such, the microcontroller 30 is able to more efficiently make use of its processing resources, without requiring it to step the receiver 20 through a plurality of frequencies that are not associated with the barrier operator 30. The operational steps taken by the barrier operator 30 when the receiver 20 is placed in the stored scan mode are generally referred to by the numeral 900, as shown in FIG. 10. Specifically, the process 900 associated with the stored scan mode may be initiated by actuating the scan mode button 878 when the barrier operator 30 is placed into service at step 710 of the process 700 as previously discussed. Once the stored scan mode is invoked at step 720 of the process 700, the process continues from step 720 to step 904 where the microprocessor 100 accesses the memory unit 130 and acquires a first frequency of a range or bandwidth of compatible command signal carrier frequencies. Next, at step 908 the barrier operator 30 determines whether a valid function code has been previously learned with the barrier operator 30, which utilizes the carrier frequency selected at step 904. If the microcontroller 100 determines that a valid function code has not been associated with the carrier frequency selected at step 904, then the process 900 proceeds to step 910. At step 910, the microcontroller 100 then selects another frequency from the range of stored carrier frequencies as previously discussed, and the step 908 is repeated. However, if the microcontroller 100 determines that a function code is associated with the carrier frequency selected at step 904, then the process 900 continues to step 914 where the receiver 20 is tuned to the frequency selected at either step 904 or step 910. Once the receiver 20 has been tuned, the microprocessor 100 waits for a valid command signal transmitted from the transmitters 80,90 to be received. If the microprocessor 100 receives a command signal at step 918, then the process 900 continues to step 920, where the function associated with the transmitted command signal is carried out by the barrier operator 30 in accordance with steps 740-820 as discussed with regard to the process 700 shown in FIG. 7. However, if the receiver 20 does not receive a command signal at step 918, then the process continues to step 924. At step 924, the microprocessor 100 determines whether all of the frequencies stored at the barrier operator 30 have been scanned by the receiver 20. If the microprocessor 100 determines that all of the carrier frequencies have not been scanned, then the process 900 continues to step 910, where the microprocessor 100 selects the next frequency for the receiver 20 to scan. But, if at step 924, the microprocessor 100 determines that all of the carrier frequencies learned and stored at the barrier operator 30 have been scanned, then the process 900 returns to step 904.

Based upon the foregoing, one advantage of the present invention is that the barrier operator is enabled to receive command signals from various remote transmitters at different carrier frequencies. Another advantage of the present invention is that the barrier operator is configured to process function codes of varying formats sent from various remote transmitters. Still another advantage of the present invention is that the barrier operator includes multiple frequency scanning modes in which to scan for command signals transmitted from various remote transmitters. These different modes allow for reduced scanning time for faster processing of the received transmissions. Yet an additional advantage of the present invention is that various transmitters utilizing various function codes and command signal carrier frequencies may be utilized to control one or more functions maintained by the barrier operator. Still a further advantage of the present invention is that the inventive operator system can learn and act upon rolling-code formatted data transmissions even if the receiver does not know the decryption key or rolling code algorithm. As a result of these advantages, the system can receive at multiple frequencies so as to allow compatibility with older products, compatibility with other manufacturer's products, and the system can learn a transmitter using any frequency that allows it to achieve better performance that the manufacturer's standard frequency.

Thus, it can be seen that the objects of the invention have been satisfied by the structure and its method for use presented above. While in accordance with Patent Statutes, only the best mode and preferred embodiment has been presented and described in detail, it is to be understood that the invention is not limited thereto and thereby. Accordingly, for an appreciation of the true scope and breadth of the invention, reference should be made to the following claims.

What is claimed is:

1. A method of processing received command signals transmitted from a wireless transmitter to a barrier operator so as to actuate an access barrier, the method comprising:

scanning by a receiver in at least one of two ways to detect a command signal frequency wherein said scanning can be done in an initial use mode, a scan all mode, and a scan stored mode by selectively actuating a scan button; wherein in said initial use mode, said receiver checks one of two frequencies and sets said receiver if data is received on one of the two frequencies; wherein in said scan all mode, said receiver checks a number of frequencies and sets said receiver if data is received on one of said number of frequencies; and wherein in said scan stored mode, said receiver checks previously stored frequencies and sets said receiver if data is received on one of said stored frequencies;

setting said receiver to receive said command signal at a detected signal frequency;

receiving at said receiver said command signal which includes a function code data word associated with a function to be performed by the barrier operator;

determining whether a data format of said function code data word is stored in said barrier operator;

determining whether any portion of said function code data word matches one or more fixed code tags if said data format of said function code data word is not stored at said barrier operator; and carrying out the function associated with said function code data word at the barrier operator if a match is made at said second determining step.

2. The method of claim 1, further comprising:

determining whether said function code contains a rolling code portion or a fixed code portion if the data format of said function code data word cannot be ascertained at said first determining step.

3. The method of claim 2, further comprising:

determining whether said fixed code portion of said function code data word is stored in said barrier operator.

4. The method of claim 3, further comprising:

carrying out the function associated with said function code data word at said barrier operator if said fixed code portion of said function code data word is stored in said barrier operator.

5. The method of claim 2, further comprising:

determining whether said rolling code portion of said function code is stored in said barrier operator.

6. The method of claim 5, further comprising:

carrying out the function associated with said function code data word at said barrier operator if said rolling code portion of said function code data word is stored said barrier operator.

7. The method of claim 1, further comprising:

scanning by said receiver only frequencies of said command signals associated with said function code data words stored in said barrier operator.

8. The method of claim 1, further comprising:

scanning by said receiver only predetermined frequencies within a set range of frequencies.

9. The method of claim 1, further comprising:

scanning by said receiver in predetermined frequency increments a set frequency bandwidth.

10. A barrier operator configured to learn and receive disparate wireless transmission signals to control movement of a barrier, the operator comprising:

a receiver core circuit adapted to receive wireless transmission signals containing known and unknown formatted data words;

a microcontroller associated with a memory unit, said microcontroller adapted to determine a fixed code portion of said unknown formatted data words, said microcontroller connected to said receiver core circuit and storing in said memory unit known formatted data words and unknown formatted data words if said fixed code portion can be determined when said microcontroller is in a learn mode; and a scan button associated with said microcontroller, wherein actuation of said scan button selects one of at least two scan modes for setting a frequency of operation by said receiver core circuit wherein said at least two scan mode comprise: an initial use mode wherein said receiver checks one of two frequencies and sets said receiver to receive on one of the two frequencies; a scan all mode wherein said receiver checks a number of frequencies and sets said receiver if data is received on one of said number of frequencies; and scan stored mode wherein said receiver checks previously stored frequencies and sets said receiver if data is received on one of said stored frequencies.

11. The operator according to claim 10, wherein in an operate mode said microcontroller compares received wireless transmission signals containing known formatted data words and unknown formatted data words having said fixed code portions that can be compared to those stored in said memory unit and generating a barrier command when a match is found.

12. The operator according to claim 11, wherein in said learn mode said microcontroller stores a frequency value of each known and unknown formatted data word in said memory unit, and wherein in said operate mode said receiver core circuit scans only those frequency values stored in said memory unit.

13. The operator according to claim 11, wherein in said operate mode said receiver core circuit receives said wireless transmission signals at any number of frequencies.

14. The operator according to claim 13, wherein in said operate mode said receiver core circuit scans selected discrete frequency values within a predetermined range of frequencies.

15. The operator according to claim 13, wherein in said operate mode, said receiver core circuit incrementally scans at discrete intervals within a predetermined range of frequencies.

16. The operator according to claim 10, wherein said memory unit is provided with predesignated known formatted data words for comparison to wireless transmission signals received in said learn mode.

17. The operator according to claim 10, further comprising:

a voltage controlled oscillator connected to said receiver core circuit and to said microcontroller, wherein said microcontroller provides input to said oscillator which in turn tunes said receiver core circuit to receive said signals at a selected frequency.

* * * * *

UNITED STATES PATENT AND TRADEMARK OFFICE

CERTIFICATE OF CORRECTION

PATENT NO. : 8,111,133 B2
APPLICATION NO. : 11/724937
DATED : February 7, 2012
INVENTOR(S) : Rodriguez et al.

It is certified that error appears in the above-identified patent and that said Letters Patent is hereby corrected as shown below:

In Column 14, line 7 (Claim 1, line 4) the words “at least one of two ways” should read --one of at least two ways--;

In Column 15, line 12 (Claim 10, line 18) the word “circuit” should read --circuit,--;

In Column 15, line 12 (Claim 10, line 18) the word “mode” should read --modes--;

In Column 15, line 18 (Claim 10, line 24) the words “and scan” should read --and a scan--.

Signed and Sealed this
Seventeenth Day of April, 2012

David J. Kappos

David J. Kappos
*Director of the United States Patent and Trademark Office*